US010408508B2

(12) United States Patent
Ronk et al.

(10) Patent No.: US 10,408,508 B2
(45) Date of Patent: Sep. 10, 2019

(54) OIL RECOVERY FOR REFRIGERATION SYSTEM

(71) Applicant: Carrier Corporation, Farmington, CT (US)

(72) Inventors: Aaron M. Ronk, Brewerton, NY (US); Nadine Thompson, Liverpool, NY (US); David M. Rockwell, Cicero, NY (US)

(73) Assignee: CARRIER CORPORATION, Farmington, CT (US)

( * ) Notice: Subject to any disclaimer, the term of this patent is extended or adjusted under 35 U.S.C. 154(b) by 87 days.

(21) Appl. No.: 14/898,181

(22) PCT Filed: Jun. 11, 2014

(86) PCT No.: PCT/US2014/041899
§ 371 (c)(1),
(2) Date: Dec. 14, 2015

(87) PCT Pub. No.: WO2014/204745
PCT Pub. Date: Dec. 24, 2014

(65) Prior Publication Data

US 2016/0153688 A1 Jun. 2, 2016

Related U.S. Application Data

(60) Provisional application No. 61/835,714, filed on Jun. 17, 2013.

(51) Int. Cl.
*F25B 1/047* (2006.01)
*F25B 31/00* (2006.01)

(52) U.S. Cl.
CPC ..... *F25B 31/004* (2013.01); *F25B 1/047* (2013.01); *F25B 31/002* (2013.01); *F25B 2400/05* (2013.01); *F25B 2500/16* (2013.01)

(58) Field of Classification Search
CPC .. F25B 31/002; F25B 31/004; F25B 2500/16; F25B 2400/05
See application file for complete search history.

(56) References Cited

U.S. PATENT DOCUMENTS 3,304,741 A 2/1967 Weller
3,336,762 A 8/1967 Stanley
(Continued)

FOREIGN PATENT DOCUMENTS

CN 202141263 U 2/2012
EP 0924478 A2 * 6/1999 ..... F25B 31/002
(Continued)

OTHER PUBLICATIONS

Notification of Transmittal of the International Search Report anf the Written Opinion of the International Searching Authority, or the Declaration; PCT/US2014/041899; dated Sep. 2, 2014; 4 pages.
(Continued)

*Primary Examiner* — Frantz F Jules
*Assistant Examiner* — Lionel Nouketcha
(74) *Attorney, Agent, or Firm* — Cantor Colburn LLP

(57) ABSTRACT

A refrigerant system includes a compressor having a flow of compressor lubricant therein, the compressor compressing a flow of vapor refrigerant therethrough. An evaporator is operably connected to the compressor and includes an environment to be cooled via a thermal energy exchange with a liquid refrigerant in the evaporator. A vaporizer is receptive of a first flow of compressor lubricant and refrigerant mixture from the evaporator having a first concentration of lubricant. The vaporizer uses a flow of compressed refrigerant to separate refrigerant from the first flow. A lubricant sump is receptive of a second flow of compressor lubricant and refrigerant mixture from the vaporizer having a second concentration of lubricant greater than the first
(Continued)

concentration. A heat exchanger is receptive of a third flow from the sump and uses evaporator suction gas to cool the third flow, thereby increasing its viscosity before urging the third flow to the compressor.

16 Claims, 4 Drawing Sheets

(56) References Cited

U.S. PATENT DOCUMENTS

| | | | | | |
|---|---|---|---|---|---|
| 4,353,221 | A * | 10/1982 | Taylor | B60H 1/00014 | 62/239 |
| 4,862,699 | A | 9/1989 | Lounis | | |
| 4,949,546 | A * | 8/1990 | Klusmier | F25B 9/14 | 165/174 |
| 5,042,271 | A | 8/1991 | Manz | | |
| 5,189,882 | A | 3/1993 | Morgan, Sr. | | |
| 5,226,300 | A | 7/1993 | Christensen et al. | | |
| 5,302,300 | A * | 4/1994 | Porri | B01D 5/009 | 210/177 |
| 5,325,675 | A * | 7/1994 | Manz | F25B 45/00 | 62/149 |
| 5,419,155 | A * | 5/1995 | Boehde | F25B 1/047 | 62/470 |
| 5,535,596 | A | 7/1996 | Todack | | |
| 5,570,583 | A | 11/1996 | Boehde et al. | | |
| 6,067,804 | A | 5/2000 | Moeykens et al. | | |
| 6,170,286 | B1 * | 1/2001 | Keuper | F25B 31/004 | 62/113 |
| 6,182,467 | B1 * | 2/2001 | Zhong | F04C 29/025 | 62/470 |
| 6,408,637 | B1 | 6/2002 | Hanson et al. | | |
| 6,672,102 | B1 * | 1/2004 | Huenniger | F25B 1/047 | 62/472 |
| 2008/0210601 | A1 | 9/2008 | Shoulders | | |
| 2008/0271477 | A1 * | 11/2008 | Holmes | F25B 31/004 | 62/468 |
| 2009/0126376 | A1 | 5/2009 | Knoll | | |
| 2010/0251756 | A1 | 10/2010 | Scarcella et al. | | |
| 2013/0186128 | A1 * | 7/2013 | Kim | F25B 31/004 | 62/470 |

FOREIGN PATENT DOCUMENTS

| | | | |
|---|---|---|---|
| EP | 25433941 | | 9/2013 |
| JP | S56146095 | A | 11/1981 |
| JP | H04136661 | A | 5/1992 |
| WO | 9423252 | A1 | 10/1994 |

OTHER PUBLICATIONS

Chinese Office Action and Search Report for application CN 201480034539.7, dated Mar. 21, 2017, 7pgs.

* cited by examiner

OIL RECOVERY FOR REFRIGERATION SYSTEM

BACKGROUND

The subject matter disclosed herein relates to refrigeration systems. More specifically, the subject matter disclosed herein relates to compressor oil recovery for refrigeration systems.

Refrigeration systems typically include a compressor delivering compressed refrigerant to a condenser. From the condenser, the refrigerant travels to an expansion valve, and then to an evaporator. From the evaporator, the refrigerant returns to the compressor to be compressed.

The compressor is typically provided with lubricant, such as oil, which is used to lubricate bearing and other running surfaces of the compressor. During operation of the compressor, the lubricant mixes with the refrigerant operated on by the compressor, such that an oil/refrigerant mixture leaves the compressor and flows through the refrigerant system. This is undesirable, as the mixing of oil with the refrigerant flowing through the system makes it difficult to maintain an adequate supply of oil at the compressor for lubrication of the compressor surfaces. In some systems, oil separators are used immediately downstream of the compressor, but such separators often remove the oil from the mixture at a high pressure, and in many instances still include an appreciable amount of refrigerant mixed with the oil, resulting in a lower viscosity of oil at the compressor.

Other systems use electric heaters to vaporize the refrigerant from the oil/refrigerant mixture, but consequently return a heated oil to the compressor, having a reduced viscosity due at least in part to its higher temperature.

BRIEF SUMMARY

In one embodiment, a refrigerant system includes a compressor having a flow of compressor lubricant therein, the compressor compressing a flow of vapor refrigerant therethrough. An evaporator is operably connected to the compressor and includes an environment to be cooled via a thermal energy exchange with a liquid refrigerant in the evaporator. A lubricant recovery system includes a vaporizer receptive of a first flow of compressor lubricant and refrigerant mixture from the evaporator having a first concentration of lubricant. The vaporizer uses a flow of hot compressed refrigerant to boil off refrigerant from the compressor lubricant and refrigerant mixture. A lubricant sump is receptive of a second flow of compressor lubricant and refrigerant mixture from the vaporizer having a second concentration of lubricant greater than the first concentration. A heat exchanger is receptive of a third flow of compressor lubricant and refrigerant mixture from the lubricant sump having a third concentration different than the second concentration. The heat exchanger uses relatively low temperature evaporator suction gas to cool the third flow of compressor lubricant and refrigerant mixture, thereby increasing its viscosity before urging the third flow to the compressor to lubricate the compressor.

In another embodiment, a method of oil recovery for a refrigerant system includes flowing a first flow of liquid refrigerant and lubricant mixture having a first concentration of lubricant from an evaporator of the refrigerant system to a vaporizer. Refrigerant is separated from the refrigerant and lubricant mixture in the vaporizer using thermal energy transfer with a flow of relatively high temperature compressed refrigerant therethrough. A second flow of liquid refrigerant and lubricant mixture having a second concentration of lubricant greater than the first concentration is flowed to a lubricant sump. A third flow is urged from the lubricant sump through a heat exchanger where it is cooled via thermal energy exchange with a flow of evaporator suction gas. The cooled third flow is urged toward the compressor for lubrication thereof.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
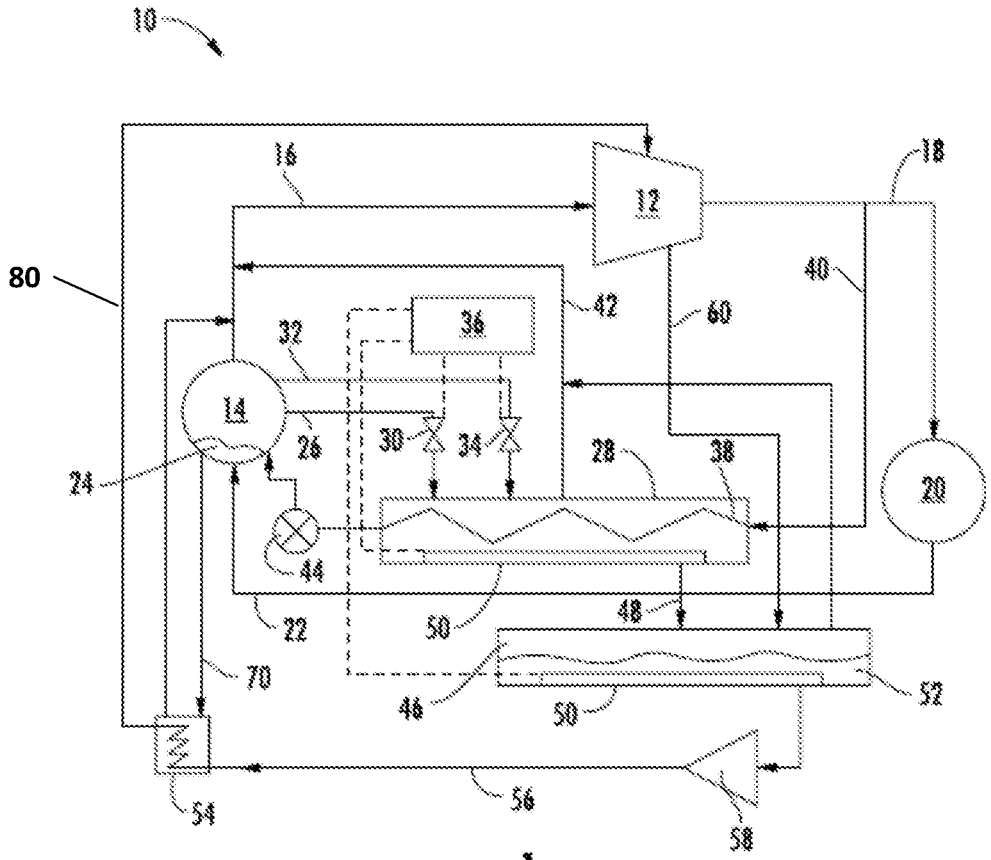
FIG. 1 is a schematic view of an embodiment of a refrigerant system.

The detailed description explains embodiments of the invention, together with advantages and features, by way of example with reference to the drawing.

DETAILED DESCRIPTION

Shown in FIG. 1 is a schematic of an embodiment of a refrigerant system 10. The refrigerant system 10 includes a compressor 12. The present disclosure provides particular benefit for screw compressors, but this disclosure is also beneficial to refrigerant systems 10 having other types of compressors 12. An evaporator 14, in some embodiments a flooded style evaporator 14, delivers a flow of refrigerant to the compressor 12 through a passage 16. From the compressor 12, the refrigerant flows through line 18 to a condenser 20. Compressed, gaseous refrigerant is cooled in the condenser 20, transferred into a liquid phase, and passed through an expansion valve (not shown) on its way to the evaporator 14 through conduit 22. At the evaporator 14, an environment to be cooled, such as a fluid flowing through a plurality of evaporator tubes (not shown), is cooled by the refrigerant at the evaporator 14. As shown, it is typical that liquid refrigerant settles from the refrigerant flow at the evaporator 14.

Lubricant, usually oil, is supplied to the compressor 12 to lubricate bearings and other running surfaces of the compressor 12. During operation of the system 10, the oil mixes with the refrigerant operated on by the compressor 12, such that the liquid refrigerant at the evaporator 14 includes a volume of oil. To avoid depletion of the supply of oil for lubricating the compressor 12, the system 10 includes features to remove the oil from the liquid refrigerant.

A return line 26 passes a first flow of liquid refrigerant/oil mixture having a first concentration of oil from the evaporator 14 to a vaporizer 28 via a vaporizer valve 30. A secondary return line 32 and secondary vaporizer valve 34 may also connect the evaporator 14 and the vaporizer 28 to provide additional refrigerant/oil mixture to the vaporizer 28. Although two valves are shown and described herein, other quantities of valves may be used. Vaporizer valve 30 and secondary vaporizer valve 34 are controlled by controller 36 and may be opened or closed dependent upon an amount of refrigerant/oil mixture in the evaporator 14 and/or a capacity of the vaporizer 28 to accept and process additional refrigerant/oil mixture.

Vaporizer 28 includes a vaporizer line 38, through which flows a hot gaseous refrigerant tapped from line 18 into vaporizer input line 40 downstream of the compressor 12, and upstream of the condenser 20. The vaporizer 28 is essentially a heat exchanger used to extract refrigerant from the refrigerant/oil mixture. Vaporizer line 38 may be a coil or plurality of conductive heat exchanger tubes. The gaseous refrigerant in vaporizer line 38 is at a higher temperature than the refrigerant/oil mixture. Thus the gaseous refrigerant in the vaporizer line 38 boils off and separates refrigerant from the refrigerant/oil mixture, and outputs the separated refrigerant via output line 42 toward the compressor 12 via passage 16. The refrigerant flowing through vaporizer line 38, now condensed into a liquid state, is flowed to the evaporator 14. An orifice 44 or other flow restriction device may be located between the vaporizer 28 and the evaporator 14 along vaporizer line 38 to ensure a condensation process that occurs at a nearly constant pressure and temperature across the vaporizer 28.

The vaporizer 28 outputs a second flow of liquid refrigerant/oil mixture having a second concentration of oil into an oil sump 46 via sump input 48. If further boiling off of refrigerant is desired or needed, heaters 50, for example electric heaters, connected to the controller 36 may be added to the vaporizer 28 and/or the oil sump 46.

The liquid refrigerant/oil mixture in the oil sump 46 may be at a higher temperature, and thus a lower viscosity than desired. Further, the liquid refrigerant/oil mixture may have a third concentration of oil, different than the second concentration of oil. To increase the viscosity and enhance lubrication of the compressor 12, the liquid refrigerant/oil mixture is urged from the oil sump 46 to a heat exchanger 54 via oil line 56. In some embodiments, oil pump 58 is used to urge the liquid refrigerant/oil mixture flow. Relatively low temperature suction gas 70 is flowed from the evaporator 14 and into the heat exchanger 54. A thermal exchange between the liquid refrigerant/oil mixture and the suction gas 70 cools the liquid refrigerant/oil mixture, increasing its viscosity. The liquid refrigerant/oil mixture then is flowed to the compressor 12 via the oil line 80 to lubricate the compressor 12. The liquid refrigerant/oil mixture is then returned from the compressor 12 to the oil sump 46 via sump line 60.

Figure 2:
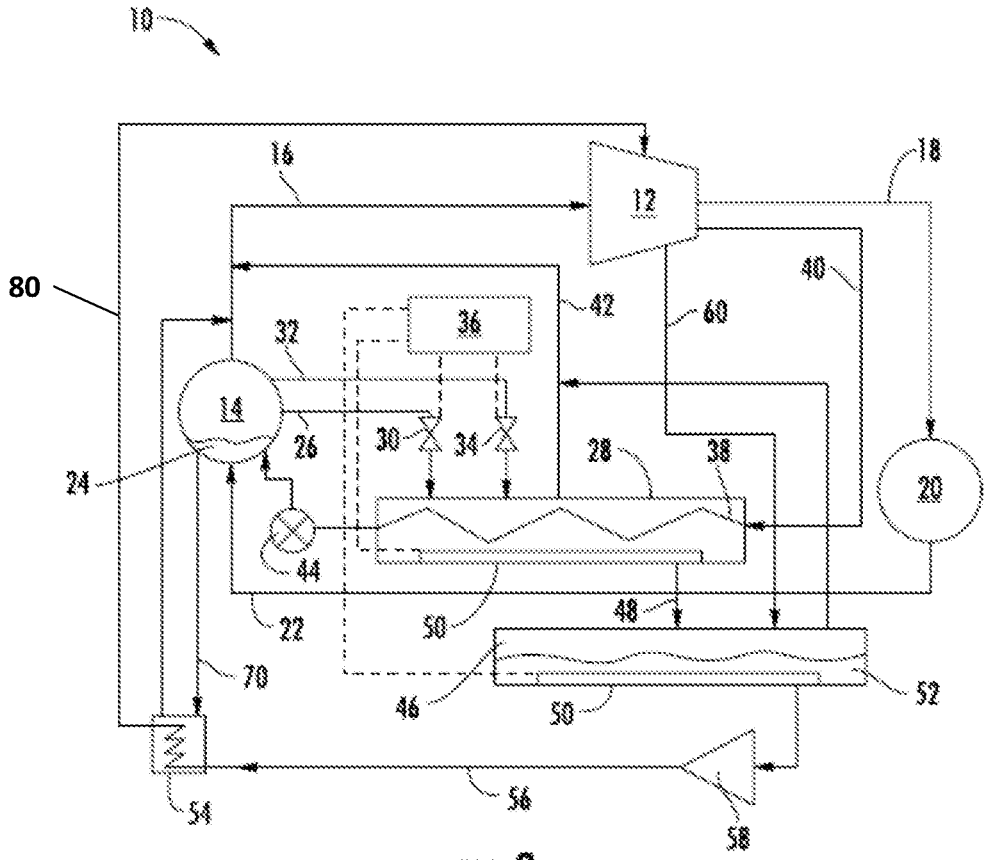
FIG. 2 is a schematic view of another embodiment of a refrigerant system.

Another embodiment is shown in FIG. 2. In this embodiment, the vaporizer input line 40 extends from a compression chamber of the compressor 12, instead of from the line 18. In some embodiments, the vaporizer input line 40 extends from a last closed lobe (not shown) of the compressor 12. Removing the hot gas refrigerant at the compressor 12, rather than downstream of the compressor 12, results in a higher temperature of the hot gas refrigerant extracted, as losses occur once the hot gas refrigerant is discharged from the compressor 12.

Figure 3:
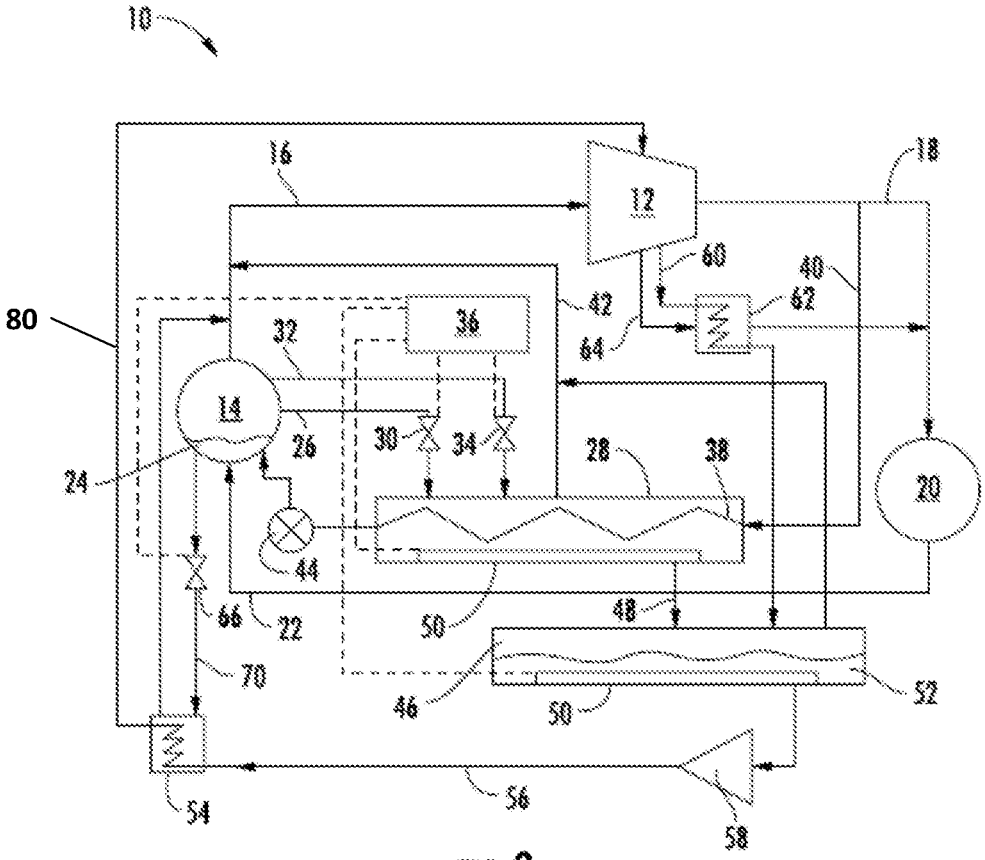
FIG. 3 is a schematic view of yet another embodiment of a refrigerant system.

Referring now to the embodiment of FIG. 3, the liquid refrigerant/oil mixture flowed to the oil sump via sump line 60 is passed through compressor heat exchanger 62. The liquid refrigerant/oil mixture passing through compressor heat exchanger 62 is heated by flowing discharge gas from the compressor 12 through the compressor heat exchanger 62 via compressor discharge line 64. Heating the liquid refrigerant/oil mixture at compressor heat exchanger 62 raises the temperature of the liquid refrigerant/oil mixture in the oil sump 46, thereby aiding in boiling off any refrigerant in the oil sump 46. Additionally, this or other embodiments may include refrigerant control valve 66, which controls flow from the evaporator 14 into heat exchanger 54 to control temperature of the liquid refrigerant/oil mixture passed through heat exchanger 54 and returned to the compressor 12.

Figure 4:
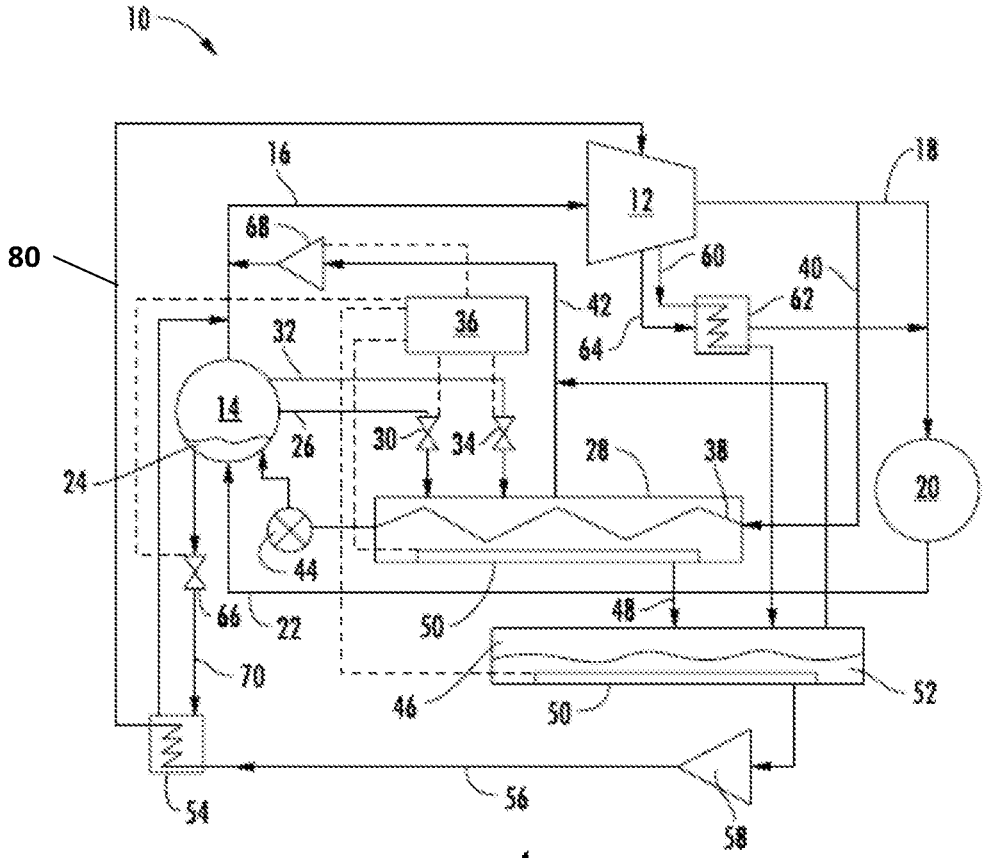
FIG. 4 is a schematic view of still another embodiment of a refrigerant system.

Referring now to FIG. 4, some embodiments may include a vacuum pump 68 to pump refrigerant through line 42 to passage 16. The vacuum pump 68 may be used to decrease pressure in vaporizer 28 and/or oil sump 46 below the pressure in evaporator 14, thus driving greater boil off of refrigerant from the vaporizer 28 and/or the oil sump 46.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A refrigerant system comprising:

a compressor having a flow of compressor lubricant therein, the compressor compressing a flow of vapor refrigerant therethrough;

a condenser operably connected to the compressor via a first compressor discharge line to direct a first flow of compressor discharge gas to the condenser;

an evaporator operably connected to the compressor including an environment to be cooled via a thermal energy exchange with a liquid refrigerant in the evaporator; and a lubricant recovery system including:

a vaporizer receptive of a first flow of compressor lubricant and refrigerant mixture from the evaporator having a first concentration of lubricant, the vaporizer using a flow of compressed refrigerant to boil off refrigerant from the compressor lubricant and refrigerant mixture;

a lubricant sump receptive of a second flow of compressor lubricant and refrigerant mixture from the vaporizer having a second concentration of lubricant greater than the first concentration;

a first heat exchanger receptive of a third flow of compressor lubricant and refrigerant mixture from the lubricant sump having a third concentration of lubricant, the first heat exchanger using evaporator suction gas flowed from the evaporator into the first heat exchanger to cool the third flow of compressor lubricant and refrigerant mixture, thereby increasing its viscosity before urging the third flow to the compressor to lubricate the compressor; and a second heat exchanger disposed along a sump line extending between the compressor and the oil sump, the second heat exchanger configured to utilize a second flow of compressor discharge gas directed to the second heat exchanger via a second compressor discharge line to heat lubricant flowed from the compressor to the oil sump via the sump line.

2. The refrigerant system of claim 1, wherein the flow of compressed refrigerant is drawn from the first compressor discharge line.

3. The refrigerant system of claim 1, wherein the flow of compressed refrigerant is drawn from a compression chamber of the compressor.

4. The refrigerant system of claim 1, further comprising a heater disposed in the vaporizer.

5. The refrigerant system of claim 1, further comprising an oil pump to urge the third flow from the oil sump through the heat exchanger to the compressor.

6. The refrigerant system of claim 1, further comprising a valve to control the flow of evaporator suction gas to the heat exchanger.

7. The refrigerant system of claim 1, further comprising a vacuum pump to urge refrigerant gas from the vaporizer toward the compressor.

8. A method of oil recovery for a refrigerant system comprising:

flowing a first flow of liquid refrigerant and lubricant mixture having a first concentration of lubricant from an evaporator of the refrigerant system to a vaporizer;

flowing a first flow of compressor discharge gas from the compressor to a condenser via a first compressor discharge line;

separating refrigerant from the refrigerant and lubricant mixture in the vaporizer using via thermal energy transfer with a flow of compressed refrigerant therethrough;

flowing a second flow of liquid refrigerant and lubricant mixture having a second concentration of lubricant greater than the first concentration from the vaporizer to a lubricant sump;

urging a third flow of liquid refrigerant and lubricant mixture from the lubricant sump through a first heat exchanger where it is cooled via thermal energy exchange with a flow of evaporator suction gas flowed from the evaporator into the first heat exchanger;

urging the cooled third flow toward the compressor for lubrication thereof;

returning the third flow from the compressor to the lubricant sump via a sump line;

heating the third flow at a second heat exchanger disposed along the sump line utilizing a second flow of compressor discharge gas flowing through the second heat exchanger via a second compressor discharge line.

9. The method of claim 8, further comprising drawing the compressed refrigerant from the first compressor discharge line.

10. The method of claim 8, further comprising drawing the compressed refrigerant from a compression chamber of the compressor.

11. The method of claim 8, further comprising heating the third flow in the oil sump to separate additional refrigerant from the second flow.

12. The method of claim 8, further comprising urging the third flow from the oil sump through the heat exchanger to the compressor via an oil pump.

13. The method of claim 8, further comprising using the heated lubricant to separate refrigerant from the third flow in the oil sump.

14. The method of claim 8, further comprising controlling the flow of evaporator suction gas to the heat exchanger via a valve.

15. The method of claim 8, further comprising urging refrigerant gas from the vaporizer toward the compressor.

16. The method of claim 15, further comprising using a vacuum pump to urge the refrigerant gas from the vaporizer toward the compressor.

* * * * *